United States Patent [19]

Dassler

[11] 4,314,413

[45] Feb. 9, 1982

[54] SPORTS SHOE

[76] Inventor: Adolf Dassler, Kreuzgasse, D-8522 Herzogenaurach, Fed. Rep. of Germany

[21] Appl. No.: 86,446

[22] Filed: Oct. 19, 1979

Related U.S. Application Data

[63] Continuation of Ser. No. 829,470, Aug. 31, 1977, abandoned.

[30] Foreign Application Priority Data

Nov. 29, 1976 [DE] Fed. Rep. of Germany ..... 2654116
Feb. 17, 1977 [DE] Fed. Rep. of Germany ..... 2706645

[51] Int. Cl.[3] ..... A43B 5/00; A43B 13/00

[52] U.S. Cl. ..... 36/129; 36/104; 36/25 R

[58] Field of Search ..... 36/25 R, 28, 32 R, 103, 36/104, 129, 138, 132, 117

[56] References Cited

U.S. PATENT DOCUMENTS

| | | | |
|---|---|---|---|
| 2,635,364 | 4/1953 | Meingast | 36/117 |
| 2,930,149 | 3/1960 | Hack et al. | 36/28 |
| 3,283,423 | 11/1966 | Schovee | 36/138 |
| 3,300,880 | 1/1967 | Campagna | 36/104 |
| 3,613,270 | 10/1971 | Eie | 36/30 R |
| 3,824,716 | 7/1974 | Di Paolo | 36/32 R |
| 4,030,213 | 6/1977 | Daswick | 36/103 |

FOREIGN PATENT DOCUMENTS

| | | | |
|---|---|---|---|
| 2449514 | 4/1976 | Fed. Rep. of Germany | 36/132 |

*Primary Examiner*—Patrick D. Lawson

[57] ABSTRACT

A sports shoe has an extension to the sole of the shoe projecting rearwardly at the heel end, which extension is springily resilient or can be supported by resilient means on the shoe. A stiffener, for example, a metal plate can be provided to enable the resilience of the extension to be controlled. Also a separate interchangeable spring member can be provided to control the resilience of the projection.

13 Claims, 9 Drawing Figures

SPORTS SHOE

This is a continuation of application Ser. No. 829,470, filed Aug. 31, 1977, now abandoned.

The invention relates to a sports shoe, particularly but not exclusively for use in long-distance running.

For many years it has been usual to provide running shoes, and also training shoes for running competitions, with a curved portion on the heel and extending into the sole, in order to ensure a uniform rolling movement for the foot, and consequently to improve the performance of the runner. This curved portion has achieved success in competitions held on plastics tracks, in particular in short and middle distance races, since in these disciplines, in order to increase performance, the runners set down their feet relatively far forward on the sole surface by stretching the foot, so that during the rolling movement of the feet the heel is not fully stressed. It has been found, however, that in long-distance running, in which, as a rule, the strength of the runner does not last over the whole distance sufficiently for him to be able to set down his heel without fully stressing it. In those circumstances the curved portion mentioned can have a disadvantageous effect, resulting in the extreme case, in an overstressing of the heel. Such disadvantageous effects are particularly found in long-distance running, e.g. marathon running, which leads over relatively long distances and hence have stretches along ordinary roads. Because of the hard road surface encountered when setting down the foot at the end of the heel with the curved portion of the sole, the resilience of the outsole is not fully utilised and the runner suffers jarring sensations in the region of the heel bone, leading to premature fatique and to a pronounced drop in performance.

According to the present invention there is provided a sports shoe, in particular for use in long-distance running on hard tracks, having an upper and an outsole of resilient plastics material, the outsole having, at the heel end, an extension projecting rearwardly of the shoe beyond a lower rim of the shoe upper.

The invention thus abandons completely the provision of a curved portion in the heel region of the outsole and, in contrast, proposes to extend the sole at the heel end beyond the lower rim of the shoe upper or to provide it with an extension. The resilience of the material of this extension reliably absorbs the jarrings which otherwise would occur when the foot is set down at the heel end, especially on hard ground. Because of the elastic deformation the projection undergoes on setting down the foot it forms, however, a transitory curved portion which achieves the same success as was aimed for with the hitherto known curved portion at the heel end of sports shoes. In addition, however, this projection or extension produces an improvement in performance in that it effects a resilient reaction on the foot of the runner which is comparable to the so-called "catapult effect" which can be achieved on a plastic track. Shoes embodying the invention can thus combine the advantages of the hitherto known sole design with a performance-improving effect not achieved hitherto.

The projection or extension of the sole also has a damping effect when the heel is set down too hard, especially on hard ground. However, it is the catapult effect in particular which contributes to an improvement in performance in other fields of sport as well as long-distance running. When shoes embodying the invention are used by discus throwers, the thrower's technique can be improved in that the discus thrower is prevented from leaning back too far when throwing, and this leaning back can adversely affect the flight curve of the discus. A sports shoe embodying the invention develops assists the jump in high jumping using the so-called flop technique, in which the jump commences from the heel, and also in the triple jump. In the triple jump the damping effect of the sole extension on impact is, however, also noticeable to a significant degree because the second and third jump is preceded by a pronounced rolling movement of the foot from the heel forwards.

There are numerous technical possibilities for the construction of the sole projection or extension and the control of the catapult effect resulting therefrom. In a sports shoe for example with a shoe bottom comprising a heel wedge and an outsole, the sole extends with its full thickness beyond the rim of the heel wedge at the heel end and thus forms the extension. It is, however, also possible to form the extension by a special spring member that is fastened at the heel end between the shoe upper and the outsole, optionally between the heel wedge and the outsole. A combination of these two features is also possible, that is to say an extension of the outsole itself can be additionally stiffened by a spring member, in order to give the necessary springy resilience to the extension in this way. The spring member can, for example, be a flat spring made of steel, but can also be made of springily resilient plastic, for example hard polyamide. The spring should be well anchored in the shoe bottom and suitably it extends right under the heel. If required, the spring member can have a recess in the region lying under the heel, to avoid a hardening of the shoe bottom at this place.

In combination with such a spring member an extension formed by the sole can also be provided with at least one springily resilient support member. When the extension is stressed and consequently deformed, the support member presses against the outside of the shoe upper, that is to say, therefore, on the rear side of the shoe, and on the top side of the extension. Whereas a spring member in the form of a flat spring develops its spring effect through the bending occurring on stressing, the support member has a springy action because of its compression. Such support members can, for example, be fastened, in the form of ribs, to the outside of the shoe upper and/or to the top side of the extension, and can be composed of rubber or the like. In a different embodiment the heel wedge can have a recess on the side of the rim which forms a holder for a springy support member. Metal angle springs can additionally or alternatively be provided, in the angle between the extension and the outside of the shoe upper, which hold the extension in the extended position.

The invention permits a relatively simple adaption of the springy resilience needed for the catapult effect to the individual wishes, and especially to the weight, of a runner. For if a stronger catapult effect is desired, and/or the sports shoe is intended for a relatively heavy runner, it is possible to provide stiffer spring members or support members. For this purpose it is advantageous to arrange the spring members or support members so that they can be interchanged. The abovementioned construction having a recess provided in the rim of the heel wedge at the heel end is particularly suitable for this purpose. This is because spring members, made of rubber or the like, of the same size but with differing spring stiffnesses, can be arranged in such a recess.

A further variant resides in the extension sloping upwards from its rear end to the lower rim of the shoe upper. By means of this design, with an appropriate choice of material for the outsole, it is possible for the spring action of the rear sole extension to draw not only on its bending stiffness but also to a certain extent on its compressive springiness, since the slope increasing towards the front behaves similarly to the support members described, which press against the heel end of the shoe upper. No special support members are therefore required since the outsole with the construction described here is itself in a position to transmit the compression forces arising into the shoe upper. By an appropriate choice of the slope, and/or of the sole thickness remaining at the end of the extension, the intensity of the springiness can be set depending on the particular requirements. It is, however, appropriate to keep the sole extension at its rear end approximately at a thickness such that it corresponds to half the thickness under the rear rim of the shoe upper at the heel end. This dimensioning on the one hand permits the use of customary polyurethane soling materials, which provide a softness which is still acceptable when the foot is put down, and on the other hand produces the desired degree of catapult effect, without additional use of spring members or support members. Investigations have shown that, compared with conventional sports shoes, a resilient rebound of 30% and more can be achieved in this way.

The invention will be further described, by way of example, with reference to the accompanying drawings, in which.

Figure 1:
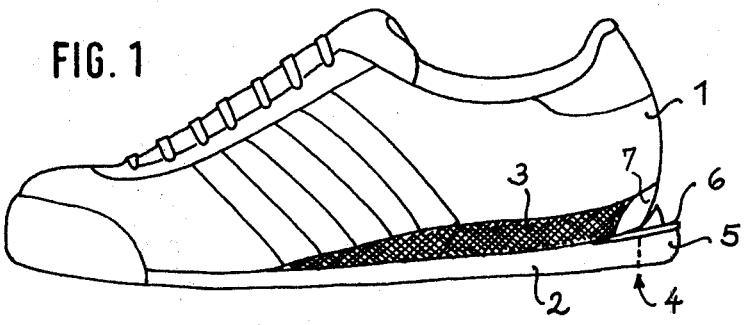
FIG. 1 shows a side view of a sports shoe according to the invention.

The sports shoe shown in FIG. 1 possesses a shoe upper 1 and a relatively soft outsole 2 made of resilient plastics. Between the insole, which is not visible, on the bottom side of the shoe upper 1 and the outsole 2, a heel wedge 3 is fastened by gluing, which heel wedge is likewise composed of springily resilient, optionally foamed, plastics and thereby serves to absorb impacts from the track. The outsole 2 does not terminate at the heel end at the point which forms a downwards extension of the lower rim of the shoe upper, and which is indicated in FIG. 1 by a broken line and designated 4 but projects backwards beyond this point by an amount of, for example, 1.5 cm, and thus forms an extension 5. An approximately 3 mm thick plate 6, tapering in thickness towards its front end and made of springily resilient, hard polyamide, is glued, or otherwise connected to the top side of the outside 2 in the region of the extension 5. The plate 6 extends between the outsole 2 and the heel wedge 3 into the shoe bottom, advantageously over a length corresponding to the whole heel region of the outsole 2, in order to secure in this way a strong hold. To avoid a stiffening of the shoe bottom 2, 3 in the heel region, the plate 6 has a recess, which is not shown at a position below the point where the runner sets down his heel.

Figure 3:
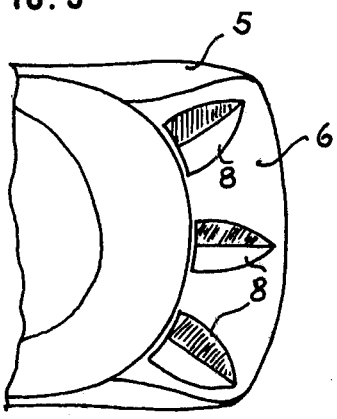

The rim of the heel wedge 3 at the heel end is strengthened with a shell 7 made of polyamide or the like, which serves as a support surface and a wear surface for there rib-shaped support members 8 which are triangular in cross-section. The support members 8 are composed of rubber or the like and are fastened, for example stuck, to the top side of the plate 6. In the unstressed state of the extension 5 there exists a small space between the support side of the extension and the shell 7. As can be seen in FIG. 3, three rib-shaped support members 8 radiate backwards from the heel and form a springily resilient stiffening for the extension 5 and the plate 6 fastened onto it.

The shoe upper 1 can have a stiffening heel cap 10 which assists the supporting action of the shell 7.

Figure 4:
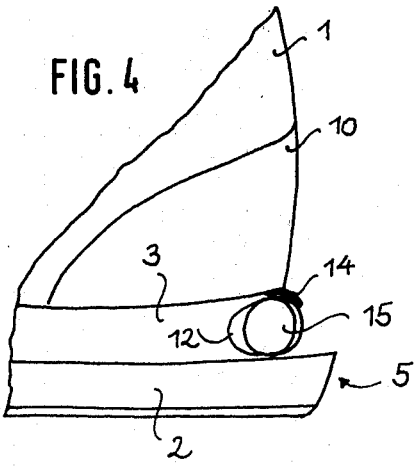
FIGS. 4 and 5 show, on an enlarged scale, a side view and a plan view of the heel region of a further embodiment of the invention.
Figure 5:
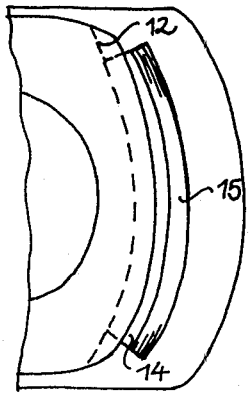

In the embodiment according to FIGS. 4 and 5 the heel wedge 3 has, on its rear side, a recess 12 which runs in a slight curve and is approximately semi-circular in cross-section. For this purpose the heel region of the heel wedge is somewhat less curved than is usually the case cf. FIG. 3. A moulded part 14, composed of, for example, polyamide, is fastened above the recess 12, between the bottom of the shoe upper 1 (insole) and the heel wedge 3, which moulded part extends over at least part of the length of the recess 12 and projects backwards. This shell-shaped moulded part 14 serves to hold a spring member 15 clamped in the recess 12, which spring member is formed, for example, of a thick round cord of rubber. A reliable holding and clamping action is ensured by appropriate roughening of the recess 12, the bottom side of the moulded part 14 and the outside of the spring member 15. The spring member 15 is so arranged in the recess 12 that it can be interchanged. Interchanging is carried out by bending the extension 5 downwards so that it releases the spring member, enabling the latter to be pulled out.

Figure 6:
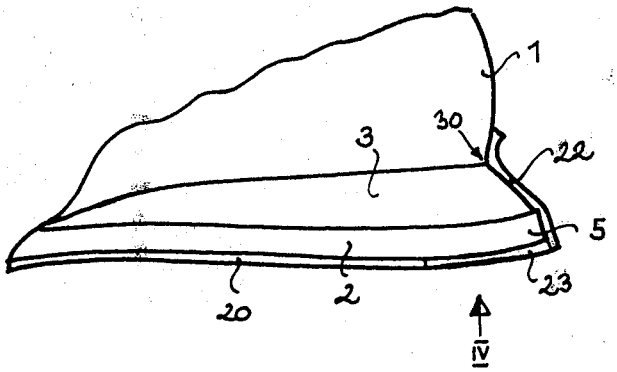
FIG. 6 shows a side view of the heel region, which is of interest here, of a further embodiment of sports shoe according to the invention, in which a heel wedge is provided.
Figure 9:
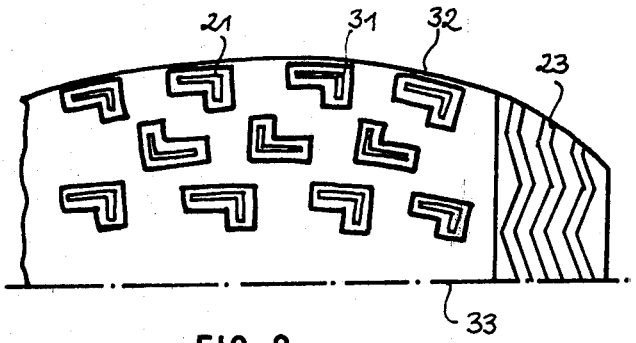
FIG. 9 shows a bottom view viewed in the direction of the arrow IX in FIG. 6, of the profile sole in the heel region of the sports shoe according to FIG. 6.

The sports shoe shown in FIG. 6 has a shoe upper 1, a heel wedge 3, made of hard polyurethane foam, fixed to the bottom side (insole) of the shoe upper, and an outsole 2 made of a springily resilient plastic, for example a polyurethane differing from that of the heel wedge 3. A profile sole 20, having profile members 21 which are shown in FIG. 9, is stuck onto the bottom side of the outsole 2. The profile members 21 have a height of about 4–5 mm. The thickness of the supporting layer of profile sole 20 carrying these profile members is, however, relatively small compared with that of the outsole 2 and amounts, for example, to only 2 to 2.5 mm compared with a thickness of about 12 mm for the outsole 2 in the region shown in FIG. 6. The profile sole 20 and the profile members 21, which are advantageously moulded in a single piece with the profile sole, are composed of a rubber material which is very resistant to wear.

The outsole 2 extends about 1.5 cm beyond the lower rim of the shoe upper at the heel end, designated by 30, and forms an extension 5. The heel wedge 3 is also continued to the end of the extension 5 but steadily decreases in thickness from the lower rim 30 of the shoe upper to the remote end of the extension. The extension 5 thus has a top surface which slopes down towards the back, and a rearward continuation 22 which is formed as a single piece with the profile sole 20, is folded round the end of the extension 5, is stuck to the said top side. The continuation extends upwards by a further amount, above the lower rim 30 of the shoe upper, along the heel end of the shoe upper.

As can be seen from FIGS. 6 and 9 the rear heel region of the profile sole 20, which consists essentially of the sole extension 5, is formed by an insertion 23 which, compared with the remaining material of the profile sole 20, is composed of particularly wear-resistant material, for example rubber. This insertion 23 also has a transverse groove profiling which differs from the profiling of the profile sole 20 (see FIG. 9). The insertion 23 can be of such shape that it is inserted, for example welded, between the profile sole 20 and the continuation 22 or that the profile sole 20 is free of profile members 21 at this position and is stuck to the insertion 23.

Figure 7:
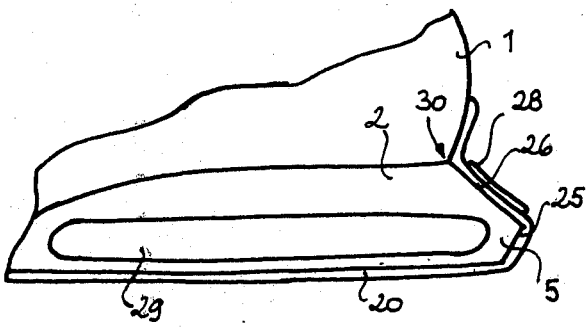
FIGS. 7 and 8 show a side view and a rear view of the heel region of a further embodiment of sports shoe according to the invention.

In the embodiment of FIG. 7 no separate heel wedge is provided, and the outsole 2 extends up to the bottom (insole) of the shoe upper 1. The extension 5 at the heel end is formed by the outsole 2 alone, this having a sloping surface 25 at its rear end running upwards towards the back and meeting the sloping surface 26 rising to the lower rim 30 of the shoe upper. The said sloping surface 26 corresponds to the slope formed by the heel wedge 3 in the embodiment according to FIG. 6. The thickness of the outsole 2 at the rear end of the extension 5, measured approximately at the lower rim of the sloping surface 25, is equal to about half of its thickness measured below the rear rim 30 of the shoe upper.

In this embodiment also, the outside of the outsole 2 is formed by a profile sole 20 the rear continuation 22 of which is laid round the extension 5 and firmly fastened, for example stuck, flatly to it. In the region of the sloping surface 26, that is to say on the top side of the extension 5, are provided stiffening ribs 28 running rearwardly and radiating from the heel; these ribs are advantageously formed as a single piece with the continuation of the profile sole 20. The thickness of the stiffening ribs 28 is advantageously suited to the type and size of the profiling of the profile sole 20, so that, for example, a sole profile suitable for high jumping is combined with a certain stiffness of the stiffening ribs 28 which impart to the extension 5, and hence to the sports shoe as a whole, adequate springiness for high jumping.

Figure 8:
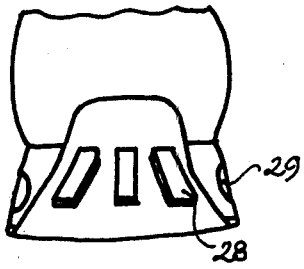

As can be seen in FIG. 8 the side rim of the sole in the heel region is sloped, in such a manner that the sole widens downwards. By this means account is taken of the individually different positioning of the foot on being set down, that is to say even with an extremely oblique setting-down of the foot a damping and a springing effect is obtained. On the side rim of the sole, a recess formed in the shape of a longitudinal groove 29, extends on both sides from the extension 5 to the waist of the sports shoe, the depth of the groove permitting the hardness of the rim of the sole to be regulated in a manner which is in itself known.

The profile, represented in FIG. 9, of the outsole 20 is formed by the profile members which are L-shaped in plan view and have smooth rims. They each have a fine recess 31 in the shape of a groove which corresponds to the basic shape of the profile members 21 and increases the grip of the bottom side of the profile members 21. Each outermost row of profile members is located immediately at the rim 32 of the profile sole, and advantageously even merges directly with the rim. The next rows of profile members 21 up to the centre line 33 of the sole are in each case arranged contrary to the previous row with respect to the position of the outer corner of the profile members 21, and their profile members are each opposite a gap in the previous row. In detail reference is made to the representation in FIG. 9 which shows the profile members in approximately actual size.

The length of the sole extension 5 depends to a certain extent on the shoe size. The length mentioned of about 1.5 cm applies, for example, to the shoe size 7. The length can, however, be changed, according to the material properties of the outsole 2 and the springy properties of the optionally provided spring members and support members, and in particular the length can be chosen to be somewhat longer than 15 cm.

Figure 2:
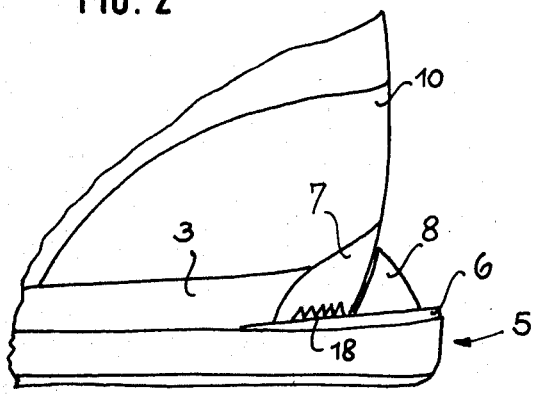
FIGS. 2 and 3 show, on an enlarged scale, a side view and a plan view of the heel region of the sports shoe shown in FIG. 1.

In use of the sports shoe represented in the drawing, when the heel is set down the extension 5 undergoes a deformation upwards which is opposed by the extension 5 because of the resilience within the outsole 2, by the plate 6 because of its bending resilience (in the embodiment of FIGS. 1 to 3) and by the support members 8 and/or the spring member 15 because of their compressive resilience. The extension 5 therefore forms a transitory curved portion, the extent of which depends on the spring stiffness of the components involved, so that a near perfect rolling movement with the foot is possible. Because of the rolling movement of the foot, the full stress of the foot is immediately transferred from the extension 5 forwards, the extension 5 is pressed back to its original position because of the available resilience, and the sportsman, again depending on the strength of the springy resilience, experiences a lifting force, that is to say a catapult effect.

It is to be understood that the chosen shape of the extension 5 in the shown illustrative embodiment, which, viewed from above, is approximately that of a rectangle, is not essential. Rather, it is also possible to allow the extension 5 to extend with its rear rim at a constant distance from the lower rim of the shoe upper. Every design of the heel of a sports shoe which merges into an extension for the purpose of effecting an elastic deformation on setting down the foot at the heel end to produce a catapult effect is included within the scope of the invention. This catapult effect is, for example, also achieved when the heel wedge is constructed throughout of a springily resilient material which, compared with the materials hitherto used, is relatively soft, whilst the outsole 2 consists of a relatively stiff material. In order to prevent a possible undesired floating resulting from this when using the sports shoe, it is sufficient to provide the shell 7, on the heel end, and the plate 6, the latter extending advantageously up to below the waist of the sports shoe. Moreover, it is also possible to provide the shell 7 with a spiked toothed edge 18 (FIG. 2) or with separate spikes on its bottom side. The teeth 18 prevent the runner from experiencing a shock on a "breaking through" of the support members 8, for example because of a certain fatigue, by the coming together of plate 6 and the rim of the shell 7. The teeth 18 can in addition also themselves have a spring function. In place of the teeth 18, the shell 7 can also have a lower rim curved (or rolled) backwards which has a spring section in the same manner.

Finally a stiffener, for example the plate 6, present on the top side of the extension 5 does not necessarily have to be connected e.g. stuck flat onto the extension 5. In many cases it can even be found advantageous if the stiffening only covers the extension.

I claim:

1. In a sports shoe for long distance running on hard tracks, comprising a flexible outsole of resilient plastics material and having a substantially flat profiled tread side, contactable with said track and a shoe upper having a heel end and a lower rim, the improvement comprising an extension of said flexible outsole projecting rearwardly substantially in the plane of the tread beyond said lower rim of the shoe upper at the heel end of the outsole, said extension being resiliently cantilevered and bendable at the heel end along an axis substantially perpendicular to the length of the shoe thereby to flex at said axis in substantially cantilever fashion to form a curved portion of said tread side during use of the shoe when pressure is applied to the bottom of the extension.

2. A sports shoe according to claim 1, further comprising a resilient heel wedge between said upper and said outsole, the outsole extending throughout its whole thickness beyond the heel wedge at the heel end forming the extension, said heel wedge having a length to thickness ratio whereby the shock of running impact with the track is dissipated equilaterally to maintain the outsole in contact with said track without sideways displacement of the heel and by said resilient flexing along said outsole bending axis.

3. A sports shoe according to claim 1, further comprising a special spring member joined to the outsole and forming said extension.

4. A sports shoe according to claim 1, further comprising a shoe bottom and a flat spring member, the flat spring member stiffening the extension and extending into the shoe bottom.

5. A sports shoe according to claim 1, further comprising at least one resilient support member located in the angle formed between the extension and the outside of the shoe upper which support member, on stressing and consequent deformation of the extension, presses against the shoe upper and the extension.

6. A sports shoe according to claim 3, wherein the spring member is fastened so that it can be interchanged.

7. A sports shoe according to claim 2, wherein the heel wedge is composed of a relatively soft plastic material, and the outsole is composed of a relatively hard plastic material, further comprising a stiffening shell bordering the rear of the heel wedge and a plate for stiffening the extension and the outsole.

8. A sports shoe according to claim 1, wherein the extension comprises a rear end and the upper comprises a lower rim, the extension sloping upwards from said rear end thereof to the lower rim of the shoe upper.

9. A sports shoe according to claim 1, further comprising a sloping top side of the extension and a relatively thin profile sole provided with profile members the profile sole forming the outside of the outsole and having a rearward continuation leading around the extension and being firmly joined to said sloping top side of the extension.

10. A sports shoe according to claim 9, wherein the continuation extends over the sloping top side of the extension and over part of the shoe upper.

11. A sports shoe according to claim 9, wherein the continuation comprises stiffening ribs running in the longitudinal direction of the sole.

12. A sports shoe according to claim 1, wherein the outsole at the rear of the shoe, widens downwardly.

13. A sports shoe according to claim 1, further comprising side walls of the outsole and means defining a respective longitudinally extending groove in each of said side walls.

* * * * *